US008893881B2

(12) United States Patent
Schneider

(10) Patent No.: US 8,893,881 B2
(45) Date of Patent: Nov. 25, 2014

(54) FOLDABLE ORGANIZER

(76) Inventor: Jonathan Neil Schneider, Los Angeles, CA (US)

( * ) Notice: Subject to any disclaimer, the term of this patent is extended or adjusted under 35 U.S.C. 154(b) by 556 days.

(21) Appl. No.: 13/187,202

(22) Filed: Jul. 20, 2011

(65) Prior Publication Data

US 2013/0020211 A1 Jan. 24, 2013

(51) Int. Cl.

| | |
|---|---|
| ***B65D 73/00*** | (2006.01) |
| *A45C 1/06* | (2006.01) |
| *B42F 7/06* | (2006.01) |

(52) U.S. Cl.

CPC ..... *A45C 1/06* (2013.01); *A45C 2001/065* (2013.01); *B42F 7/065* (2013.01)

USPC ..... 206/215; 206/232; 206/472; 281/45; 150/131

(58) Field of Classification Search

USPC ..... 206/232, 215, 224, 575, 37, 38, 425, 206/472, 473; 150/139, 140, 135, 138, 132, 150/131; 281/30, 31, 44, 45, 29

See application file for complete search history.

(56) References Cited

U.S. PATENT DOCUMENTS

| | | | | |
|---|---|---|---|---|
| 2,300,144 | A * | 10/1942 | Buxton | 150/138 |
| 2,592,918 | A * | 4/1952 | Loncich | 150/139 |
| 2,596,131 | A * | 5/1952 | Darby et al. | 150/145 |
| 4,496,058 | A | 1/1985 | Harris et al. | |
| 4,932,520 | A | 6/1990 | Ciarcia et al. | |
| 4,973,184 | A | 11/1990 | La Salle | |
| 5,244,024 | A * | 9/1993 | Oosthuizen | 150/139 |
| 5,445,199 | A * | 8/1995 | Jia | 150/136 |
| 6,808,208 | B2 | 10/2004 | Ward | |
| 7,370,794 | B2 | 5/2008 | Trane | |
| 7,546,860 | B1 | 6/2009 | Mehdizadeh | |
| 7,607,463 | B2 | 10/2009 | Huber | |
| 2011/0001313 | A1 | 1/2011 | Gwin et al. | |
| 2011/0210022 | A1 | 9/2011 | Degel | |

OTHER PUBLICATIONS

Advertising Flyer (double-sided), "WaiterWallet," undated.

Webpage: Waiter Caddy Deluxe, http://www.thewaiterdepot.com/Waiter_Caddy_Deluxe.html, printed Jul. 26, 2011.

* cited by examiner

*Primary Examiner* — Jacob K Ackun

(74) *Attorney, Agent, or Firm* — Fulwider Patton LLP

(57) ABSTRACT

A foldable organizer for restaurant waiters includes a folding case which may hold a notepad, an elongated compartment for storing paper money and receipts, a leaf having pockets for holding cards in the elongated compartment, and an exterior pocket for holding a card. The exterior pocket may be produced from a v-shaped opening integrally formed in a flexible shell that surrounds a backing. A separate insert is capable of being attached to one end of the folding case, and remains between the two halves of the folding case when in the closed position. The insert including a plurality of pages for holding cards, wherein each of the plurality of pages is joined at one end to create an accordion structure. A strap or clip for fastening the insert to the folding case is located adjacent the end opposite the one end where the plurality of pages are joined.

14 Claims, 13 Drawing Sheets

FOLDABLE ORGANIZER

FIELD OF THE INVENTION

The present invention relates to methods and devices for organizing and capturing the responsibilities of a waiter in a restaurant. More specifically, the present invention relates to methods and devices for recording food orders placed by a restaurant patron, organizing and processing a receipt and/or monies associated with a restaurant check, and organizing the responsibilities of a restaurant waiter.

BACKGROUND

The following description includes information that may be useful in understanding the present invention. It is not an admission that any of the information provided herein is prior art or relevant to the presently claimed invention, or that any publication specifically or implicitly referenced is prior art.

The responsibilities associated with a restaurant waiter or server involves numerous responsibilities and duties. Examples of various functions include memorizing the "specials of the day" and associated prices, memorizing various spices and additives in preparing a dish, as well as providing for chef suggestions to accompany certain dishes, and wine and drink pairings. In addition, a waiter must keep organized meal orders placed by different tables within the restaurant, and attend to the needs of restaurant patrons. Furthermore, a waiter must keep account of all receipts and monies exchanged throughout the night, accounting for such things as tips, bar tabs and making change for restaurant patrons.

As is customary in restaurants, a waiter may be responsible for upwards of eight tables, which could amount to servicing forty or so restaurant patrons at any given time. Restaurants are a service-related industry, and the degree of care and precision a waiter displays while servicing the restaurant patrons is part of the measure of a restaurant's performance. In fact, a well-known restaurant rating guide, ZAGAT, identifies service as the second most important factor in determining a restaurant's rating, second only to food quality. An organized waiter often can provide a better service experience for a restaurant patron.

In juggling their various duties and responsibilities, many waiters are faced with the time-consuming task of searching for the needed article or information throughout the service of their tables. This could reflect poorly on the service being provided to the restaurant patron, and result in a lower tip and a lower approval rating for the restaurant.

The present invention addresses these limitations by providing for a novel method and device for capturing and organizing information common to restaurant waiters. The present invention further provides a novel method and device for increasing efficiency and limiting errors associated with restaurant waiter duties and responsibilities.

SUMMARY OF THE INVENTION

The present invention provides methods and devices for capturing and organizing information common to restaurant waiters in performing their waiting duties and responsibilities.

In one embodiment, the organizer comprises a folding case with a leaf having an end affixed within an elongated compartment. The leaf may include a plurality of pockets. For example, the leaf may include a first and a second pocket, each pocket having an opening and configured to hold a card. The openings of the first and second pockets being accessible through the elongated opening of the elongated compartment. The first pocket is located adjacent the top interior side and the second pocket is located adjacent the bottom interior side, such that the pockets do not interfere with closing the folding case.

In another embodiment, the organizer comprises a folding case having a rear exterior side including a backing and a flexible shell covering at least a substantial portion of the rear exterior side of the folding case, and a v-shaped opening integrally formed in the flexible shell. The v-shaped opening creates a rear pocket between the flexible shell and the backing, and the rear pocket is configured to accept a card.

In another embodiment, the organizer comprises a folding case and an insert capable of being attached to one end of the folding case. The insert remains between the top interior panel and the bottom interior panel of the folding case when the folding case is in the closed position; the insert including a plurality of pages for holding cards such as credit cards or driver's licenses. Each of the plurality of pages is joined at one end, and the means for fastening is located adjacent the end opposite the one end where the plurality of pages are joined. A strap or clip may be used to attach the insert to one end of the folding case.

Other features and advantages of the present invention will become more apparent from the following detailed description of the invention, when taken in conjunction with the accompanying exemplary drawings.

DETAILED DESCRIPTION OF EMBODIMENTS

Figure 1:
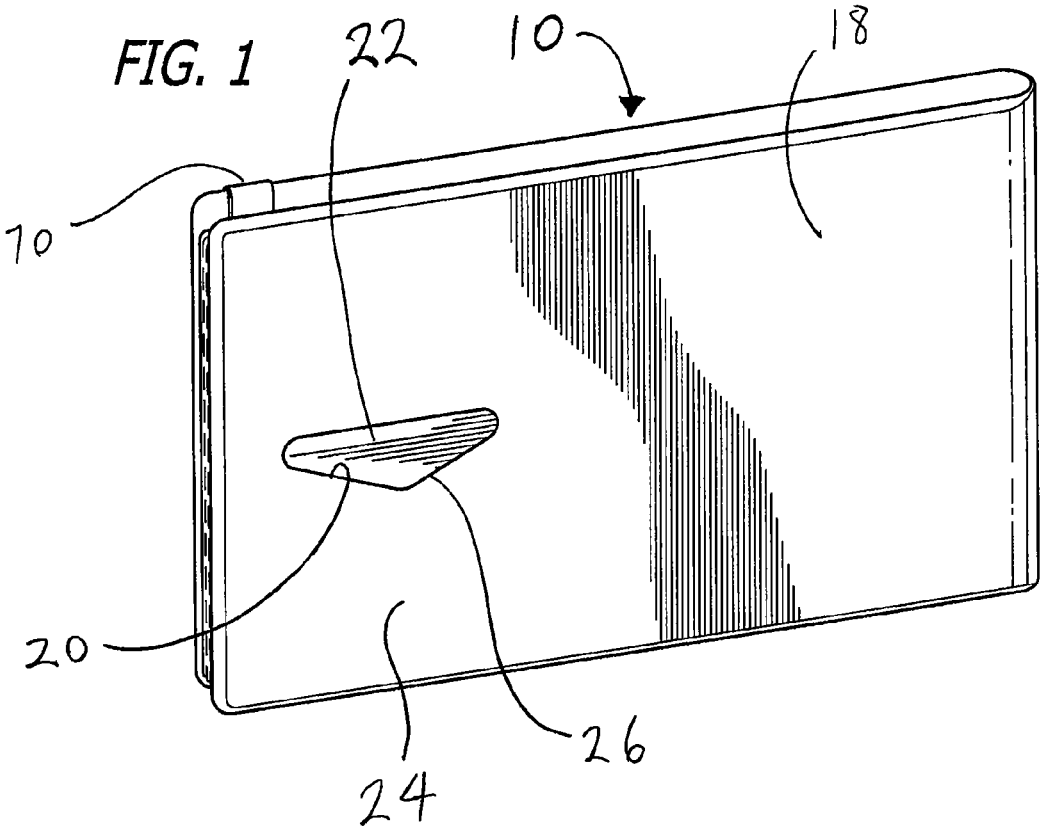
FIG. 1 depicts a top, front, perspective view of the foldable organizer in a closed position, in accordance with an embodiment of the present invention.
Figure 2:
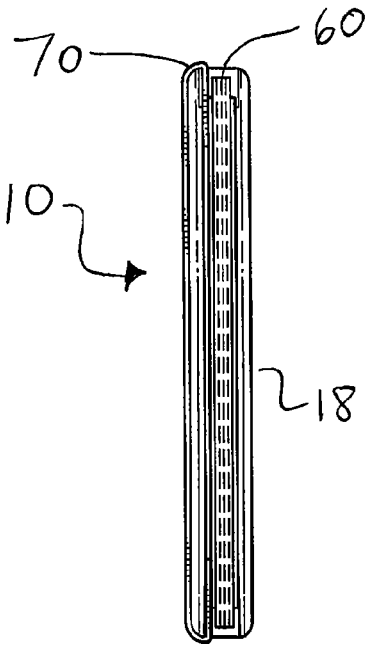
FIG. 2 is a left side elevation view of the foldable organizer in a closed position.
Figure 3:
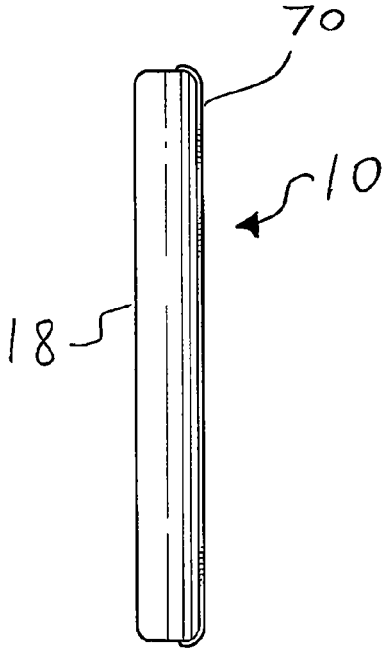
FIG. 3 is a right side elevation view of the foldable organizer in a closed position.
Figure 4:
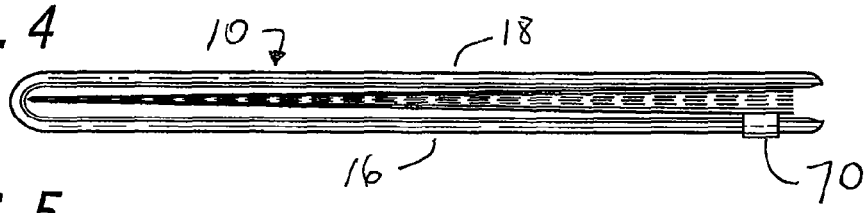
FIG. 4 is a bottom plan view of the foldable organizer in a closed position.
Figure 5:
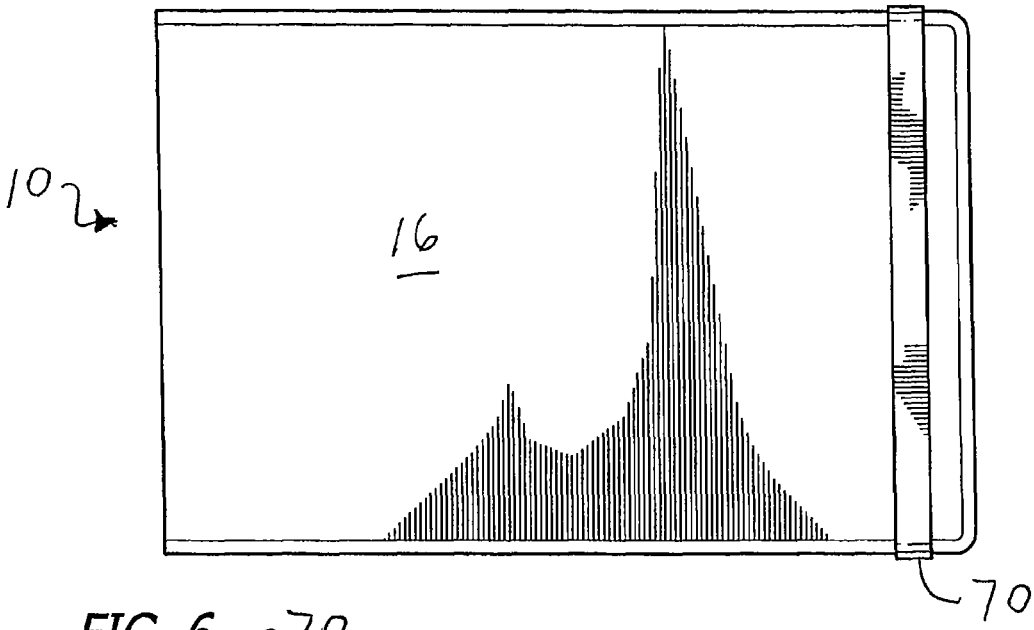
FIG. 5 is a rear elevation view of the foldable organizer in a closed position.
Figure 6:
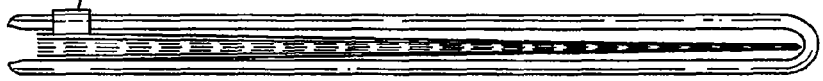
FIG. 6 is a top plan view of the foldable organizer in a closed position.

In various embodiments, the foldable organizer comprises a folding case having a compartment for storing receipts. The foldable organizer also may be described as a stationary-type portfolio or as a padfolio, and may be suggestive of a wallet. In one embodiment, a foldable organizer designed to capture various information helpful to a waiter or server. Such a foldable organizer may include a folding case containing a notepad; at least one compartment for storing paper money and receipts; a clear pocket for inserting information; a writing utensil holder; a rear card pocket for holding a credit card; and a credit card swipe machine to processing credit cards. The folder organizer also may include an elongated leaf affixed within the compartment, dividing the compartment into two sections, and the leaf further having pockets for accepting and holding cards. The pockets are positioned on the leaf so as to avoid interfering with the closing of the folding case. Referring now to the drawings, like parts are designated by like reference characters throughout the several views.

Figure 7:
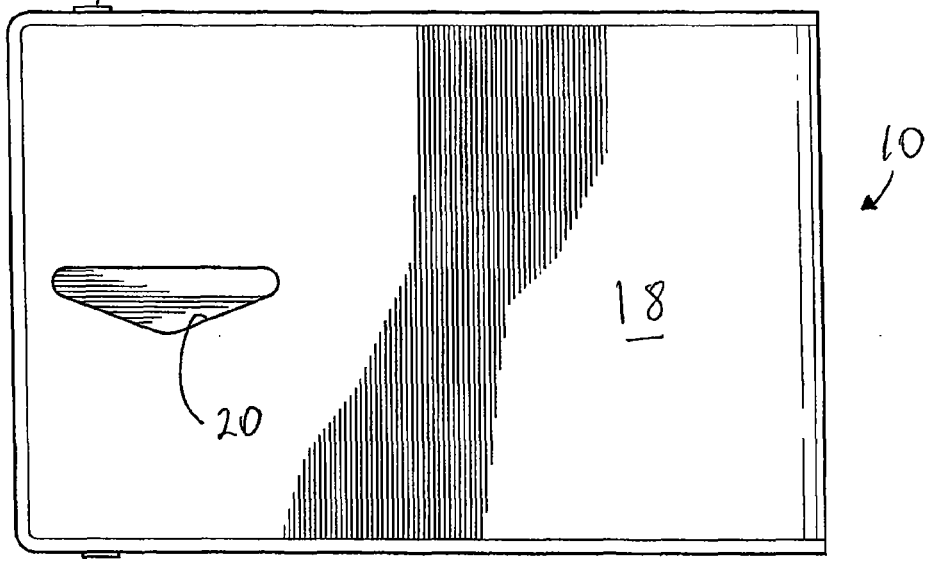
FIG. 7 is a front elevation view of the foldable organizer in a closed position.
Figure 9:
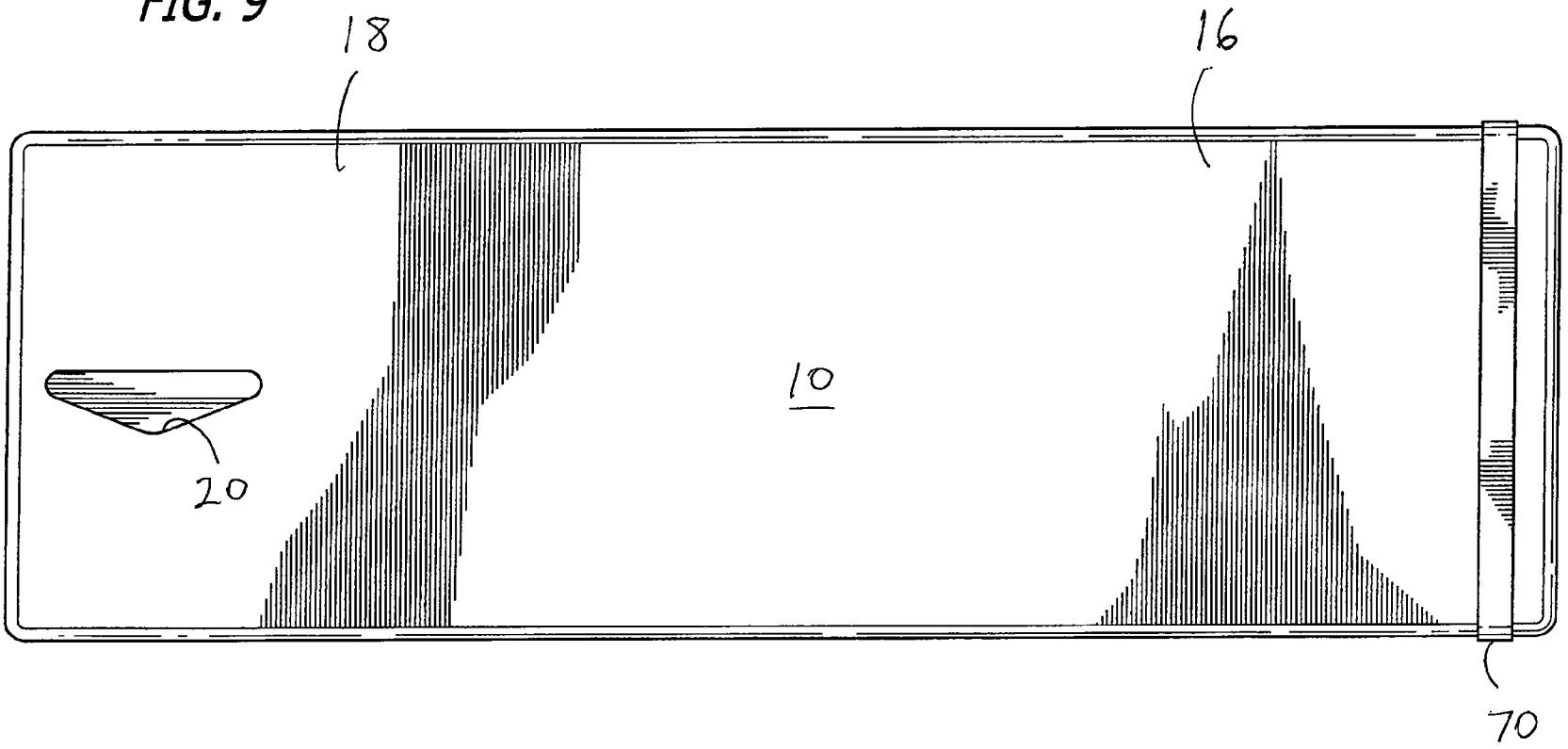
FIG. 9 is an elevational view of the exterior of the foldable organizer in an open position.
Figure 18:
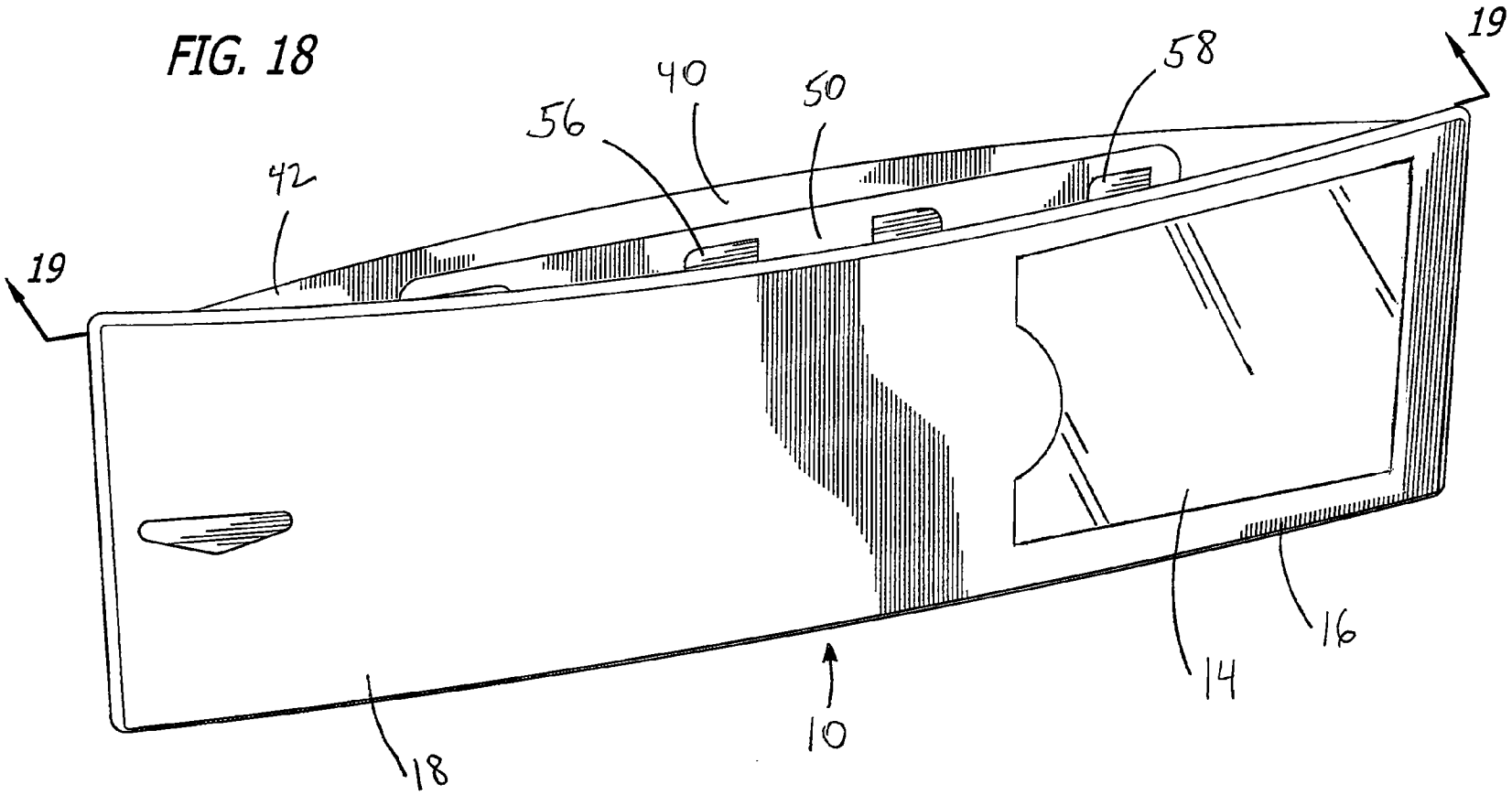
FIG. 18 is a rear, top, perspective view of the ORGANIZER in an open position showing the compartment slightly open and a separate pocketed leaf contained within the compartment.
Figure 19:
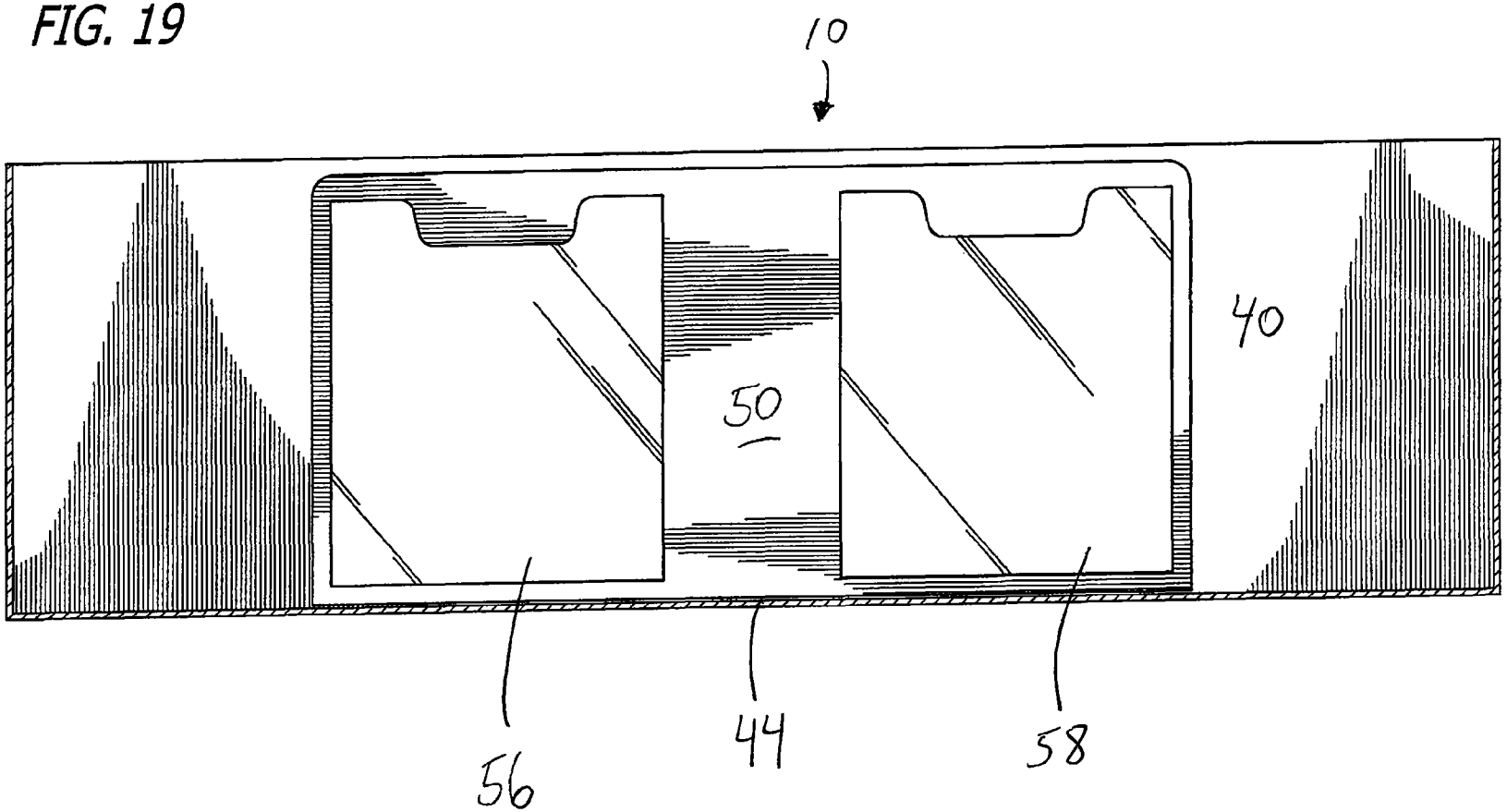
FIG. 19 is a cross-sectional view taken along line 19-19 showing the rear of the separate pocketed leaf attached to the bottom of the compartment of the ORGANIZER.
Figure 20:
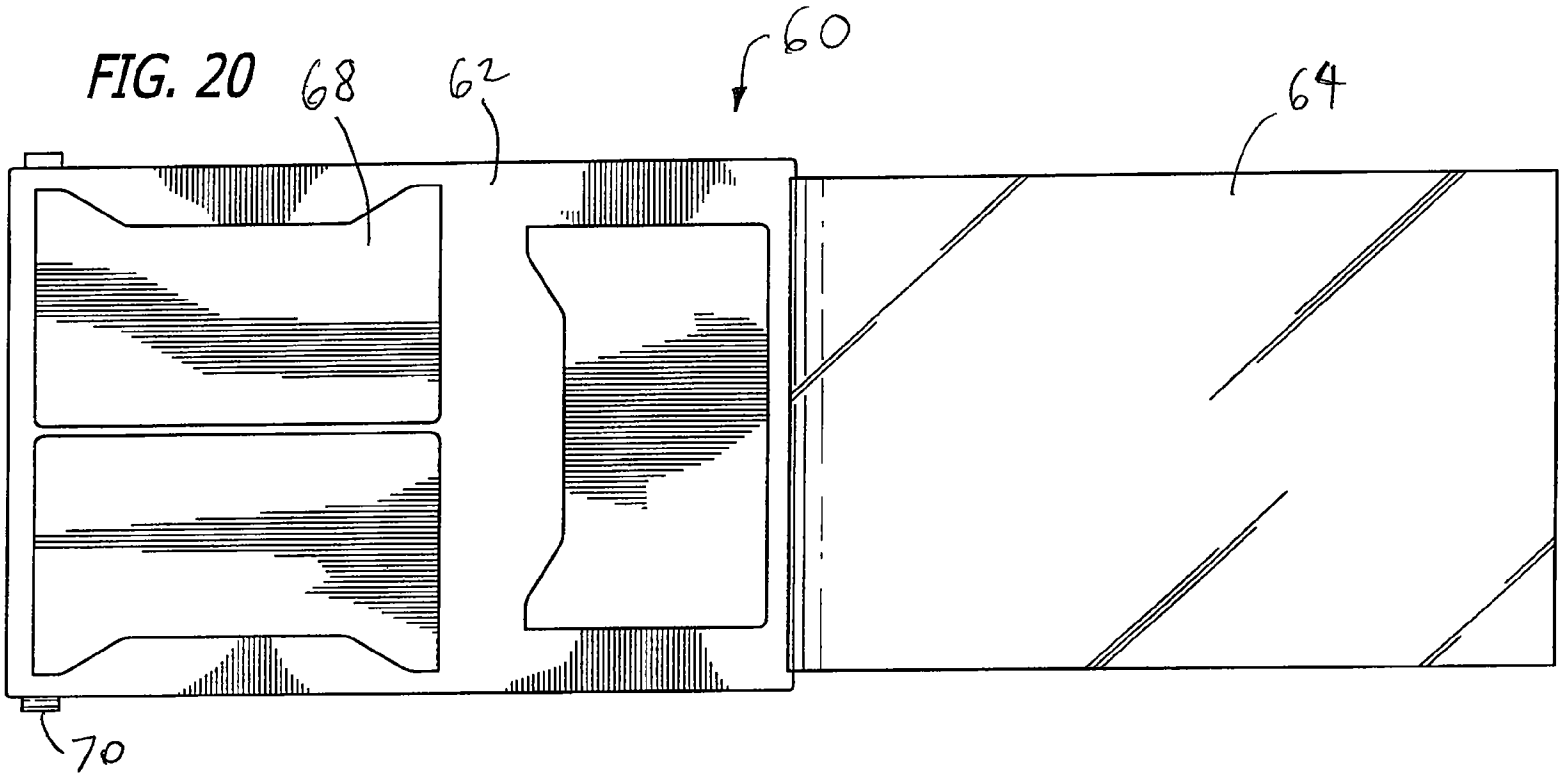
FIG. 20 is a front elevational view of the insert for foldable organizer in an open position.
Figure 21:
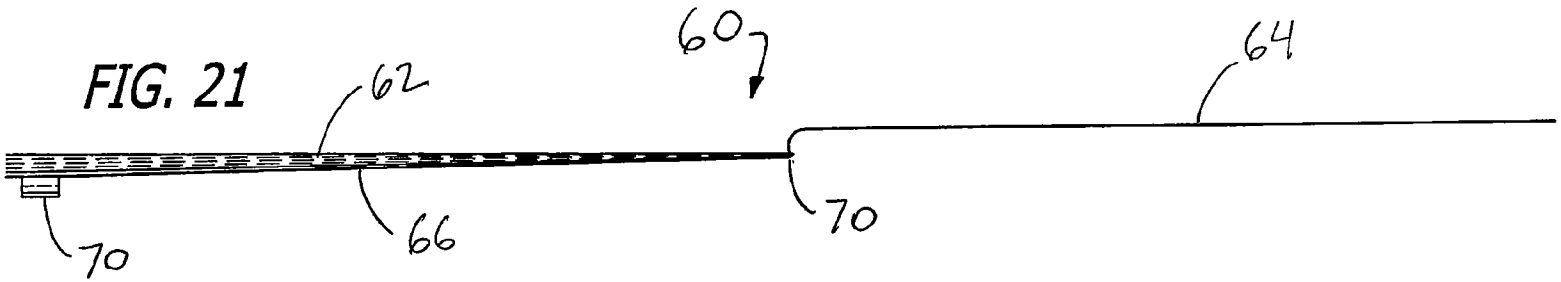
FIG. 21 is a side view of the insert for foldable organizer in an open position.

FIGS. 1 and 7 depict a foldable organizer case 10 in a closed position, and showing the rear pocket 20 for storing cards such as a credit card or a point-of-sale (POS) computer swipe card. One suitable dimension for the rear pocket is 2.8 inches (7.2 cm) by 2.6 inches (6.7 cm). The rear pocket 20 is also illustrated in FIGS. 9 and 18, depicting the foldable organizer case 10 in an open position.

The rear pocket 20 preferably is integrally formed on the rear exterior section 18 of the foldable organizer case 10. The rear exterior section 18 includes a backing 22 and a flexible shell 24 covering substantially the entire rear exterior section of the folding case 10. A v-shaped opening 26 is formed integrally in the flexible shell 24. The v-shaped opening 26 creates the rear pocket between the flexible shell 24 and the backing 22, and the rear pocket 20 is configured to accept a card such as a credit card or a POS card. The integrally formed rear pocket 20 streamlines the appearance and leaves a large surface on the rear exterior section 18 to deboss and/or print custom branding or logos.

Vinyl (or PVC) is a suitable material for the flexible shell 24. Leather is another suitable material for the flexible shell. The backing 22 is preferably rigid. Cardboard may be a suitable material for the backing 22. In one embodiment, a sheet of vinyl is adhered to the backing 22 and behind the flexible shell on the rear exterior section 18 of the foldable organizer case 10. In this manner, a card in the rear pocket 20 would be sandwiched between two layers of vinyl. The additional layer of material placed over the backing 22 and behind the flexible shell 24 of the rear exterior section 18 also helps avoid the seals or lines that a non-integrally formed rear pocket would create.

The v-shape of the opening 26 for the rear pocket 20 facilitates removal of the inserted card from the pocket. The rear pocket 20 preferably is located near the bottom left corner of the rear exterior section 18 of the foldable organizer case 10. Otherwise, having the rear pocket positioned more toward the center of the rear exterior section of the foldable case, could increase the possibility that the inserted card may slip between the backing and the shell.

A small sealed ridge may be placed around the pocket to make the rear opening stronger and less prone to tearing. A triangle or v-shaped opening 26 is preferred to reduce the likelihood of tearing at the top corner of the rear pocket 20.

Figure 10:
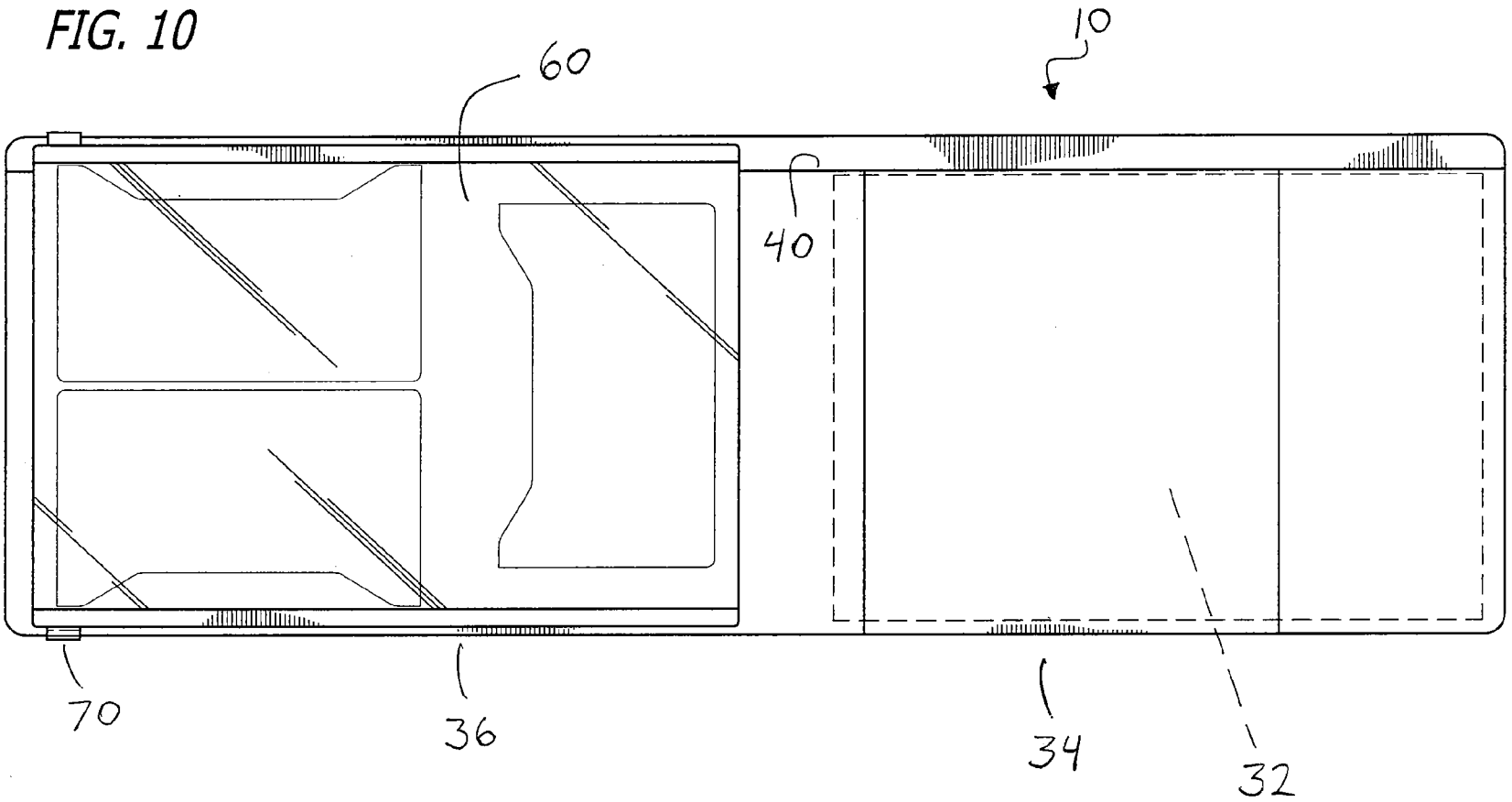
FIG. 10 is an elevational view of the interior of the foldable organizer in an open position with a writing pad shown in dashed lines.
Figure 15:
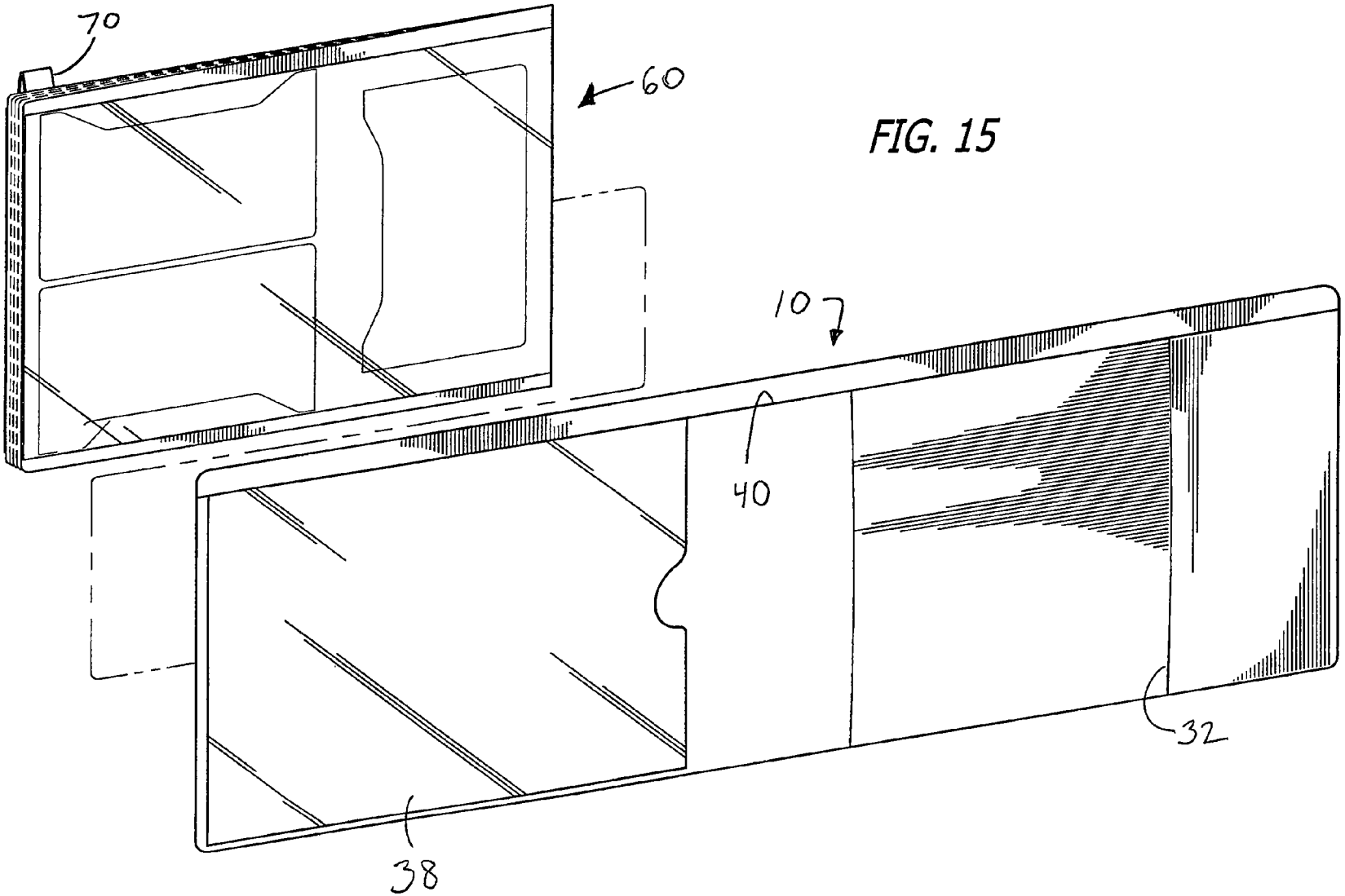
FIG. 15 is a front, top, left exploded view of the interior section with the foldable organizer in an open position showing the insert removed.

FIGS. 10 and 15 depict the foldable organizer case 10 in an open configuration. The foldable organizer case which may contain a notepad or waiter pad for taking food orders placed by restaurant patrons, as well as special requests and other notes regarding the table. The foldable organizer case may include an upper interior pocket into which the back of the notepad may be inserted to hold the notepad in the case.

The bottom interior panel 34 and the top interior panel 36 are exposed when the foldable organizer case 10 is in the open configuration. A waiter pad may be configured to be placed in any portion of the organizer case 10. As illustrated in FIG. 15, the top interior panel 36 of the organizer case 10 further comprises a clear interior pocket 38 for displaying various information related to the function of waiting tables, serving restaurant patrons, and/or other relevant information, when the organizer case 10 is in the open position. The foldable organizer case 10 also may include a lower interior pocket 32 for storing a card such as a credit card.

The organizer also may include a pen holder. The pen holder may be a channel in the fold of the case that will allow a pen to slide in and out. Another embodiment of the organizer may also include a light preferably located at the top of the top interior panel to illuminate the waiter pad 12 and or the clear pocket, or both, when the foldable organizer case is in the open position.

Figure 16:
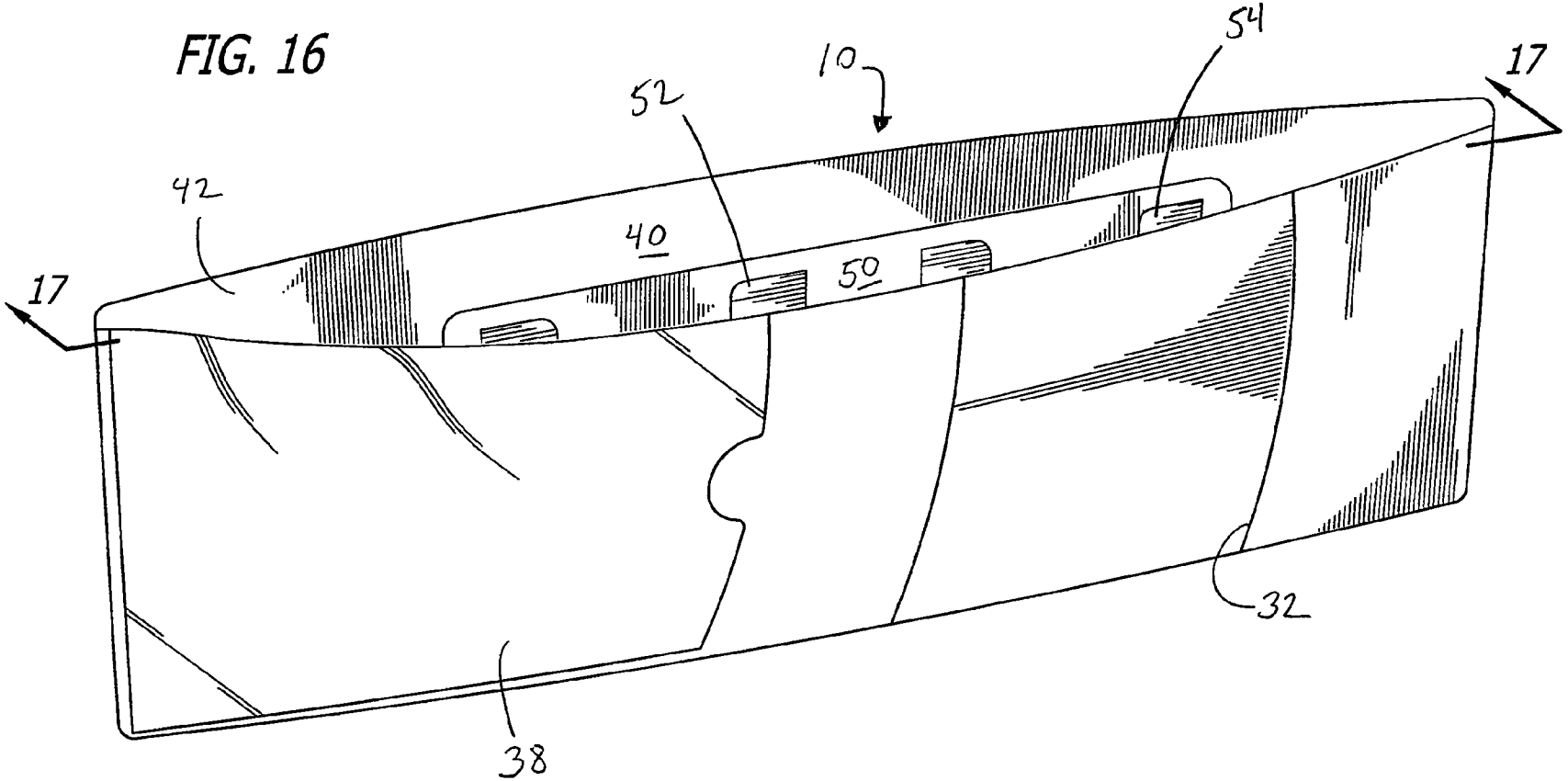
FIG. 16 is a front, top, perspective view of the ORGANIZER in an open position showing the compartment slightly open and a separate pocketed leaf contained within the compartment.
Figure 17:
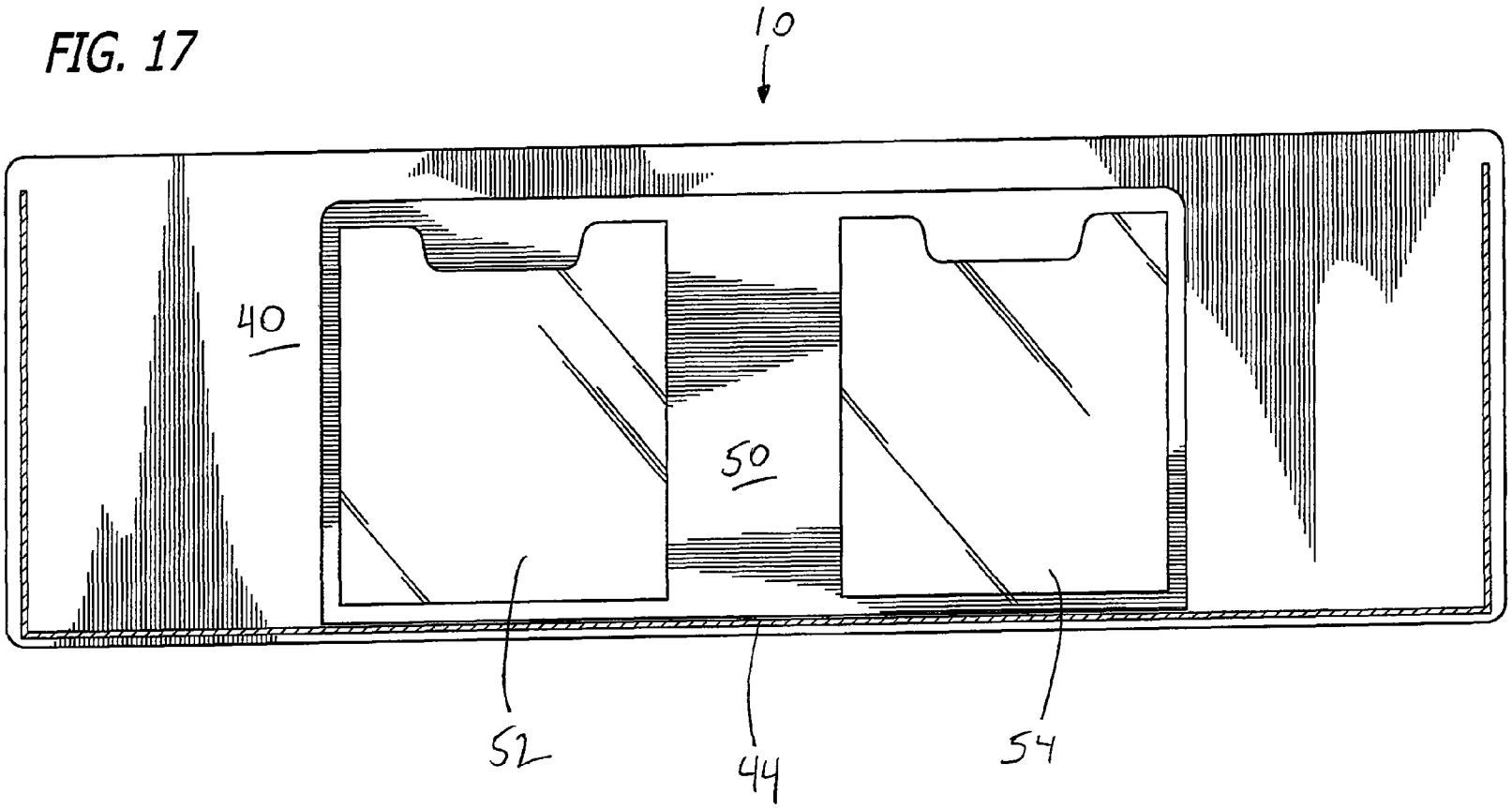
FIG. 17 is a cross-sectional view taken along line 17-17 showing the front of the separate pocketed leaf attached to the bottom of the compartment of the ORGANIZER.

FIG. 16 further depicts at least one billfold compartment 40 for storing paper items, such as paper money, receipts, and bills. The compartment 40 preferably is elongated, with an opening that runs nearly the entire length of the open case 10. The compartment may have only a single common storage space, or, in the alternative, the compartment may be divided into two separate areas, or sub-compartments. For example, one for cash, and one for credit card receipts. These sub-compartments are separated or divided by a flexible leaf 50. Preferably, the bottom of the leaf is affixed to the bottom 44 of the compartment 40. In one embodiment, the leaf 50 is positioned in the middle of the billfold compartment 40, and does not to extend the entire length of the compartment 40. The lateral ends of the leaf 50 are free or unaffixed to the compartment 40. The leaf 50 may act as a divider without having its lateral ends affixed to the compartment 40 and still substantially isolate the sub-compartments created by the leaf 50, while allowing for less constrictive access to the sub-compartments. This also allows the billfold area to be closely positioned at the top and bottom, making the compartment tight in those areas, and allows for less bulk in the foldable organizer. In one embodiment, the leaf 50 sits one centimeter below the height of the compartment, and only extends wide enough to hold two credit cards. The leaf 50 can be moved forward and back to provide the user with access to separate areas of the billfold compartment 40, as well as to the pockets of the leaf 50.

The leaf 50 preferably includes four pockets 52, 54, 56, and 58, each having an opening and configured to hold a card such as a credit card. The first pocket 52 preferably is located adjacent the top interior panel and the second pocket 54 is located adjacent the bottom interior panel such that the pockets do not interfere with closing the folding case 10. Preferably, two pockets are placed symmetrically on each side of the leaf 50. Thus, first pocket 52 and third pocket 56 are located adjacent the top interior panel and the second pocket 54 and fourth pocket 58 are located adjacent the bottom interior panel. Various guests' credit cards and/or driver's licenses can be stored in the leaf 50 within the billfold compartment 40. Each pocket preferably includes a clear material to allow the user to identify each guest's credit card and/or driver's license. Preferably, each pocket opens toward the top of the billfold compartment.

Figure 8:
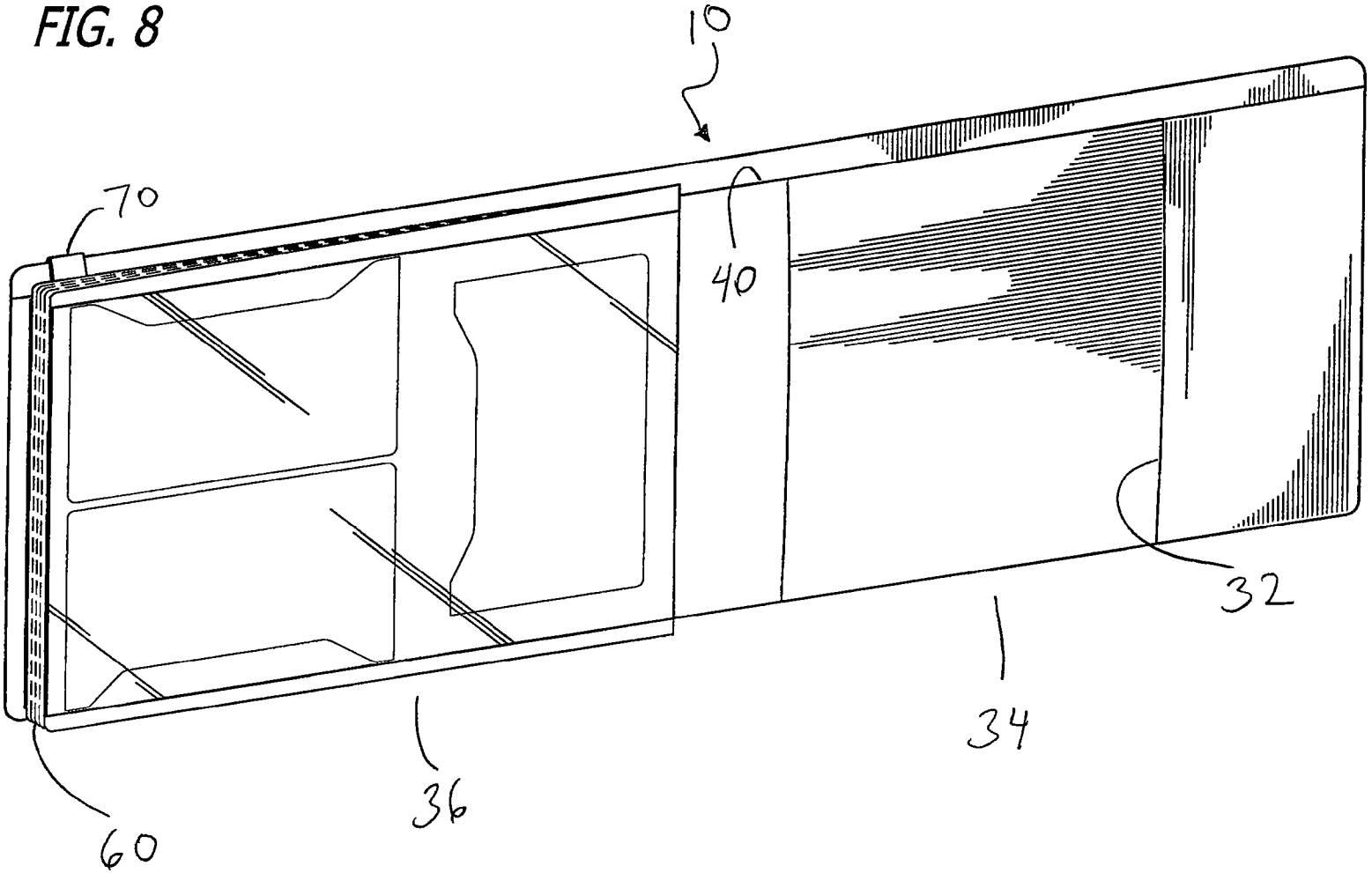
FIG. 8 is a perspective view of the interior of the foldable organizer in an open position.
Figure 11:
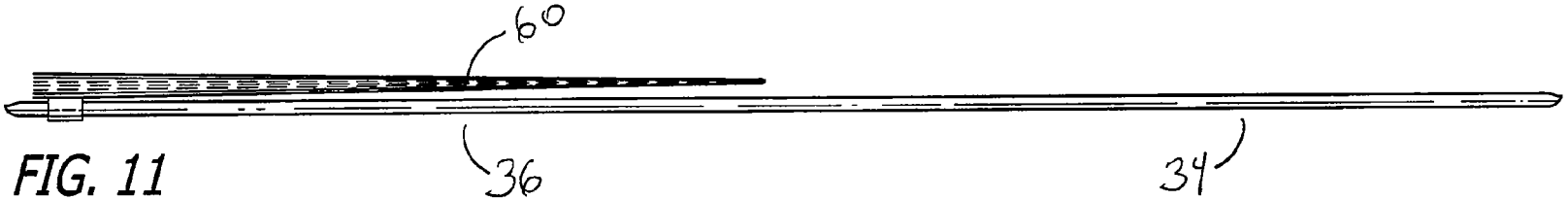
FIG. 11 is a bottom plan view of the foldable organizer in an open position.
Figure 12:
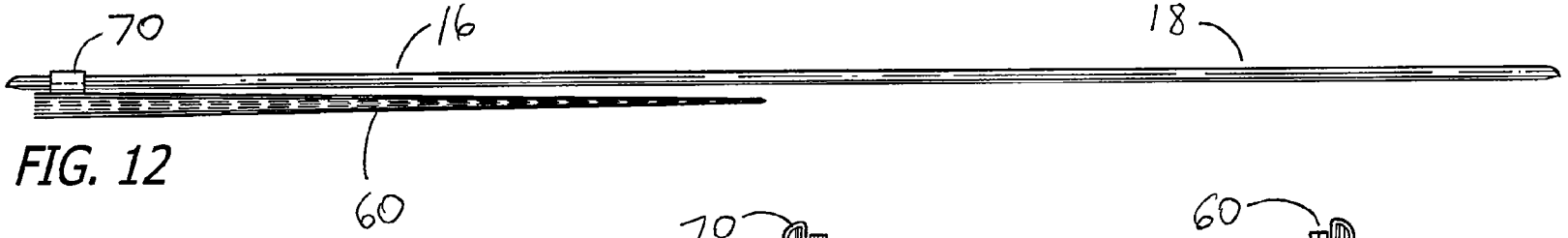
FIG. 12 is a top plan view of the foldable organizer in an open position.
Figure 13:
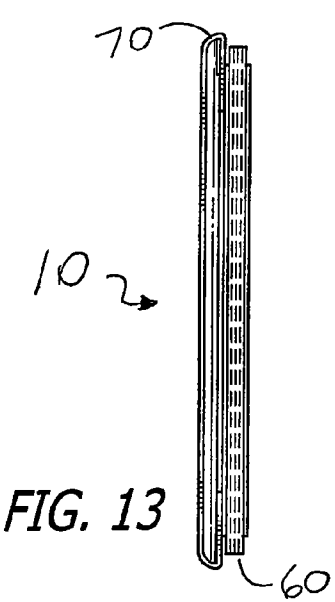
FIG. 13 is a left side elevation view of the foldable organizer in an open position.
Figure 14:
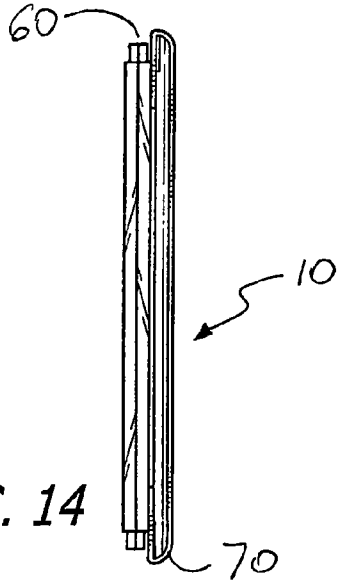
FIG. 14 is a right side elevation view of the foldable organizer in an open position.
Figure 22:
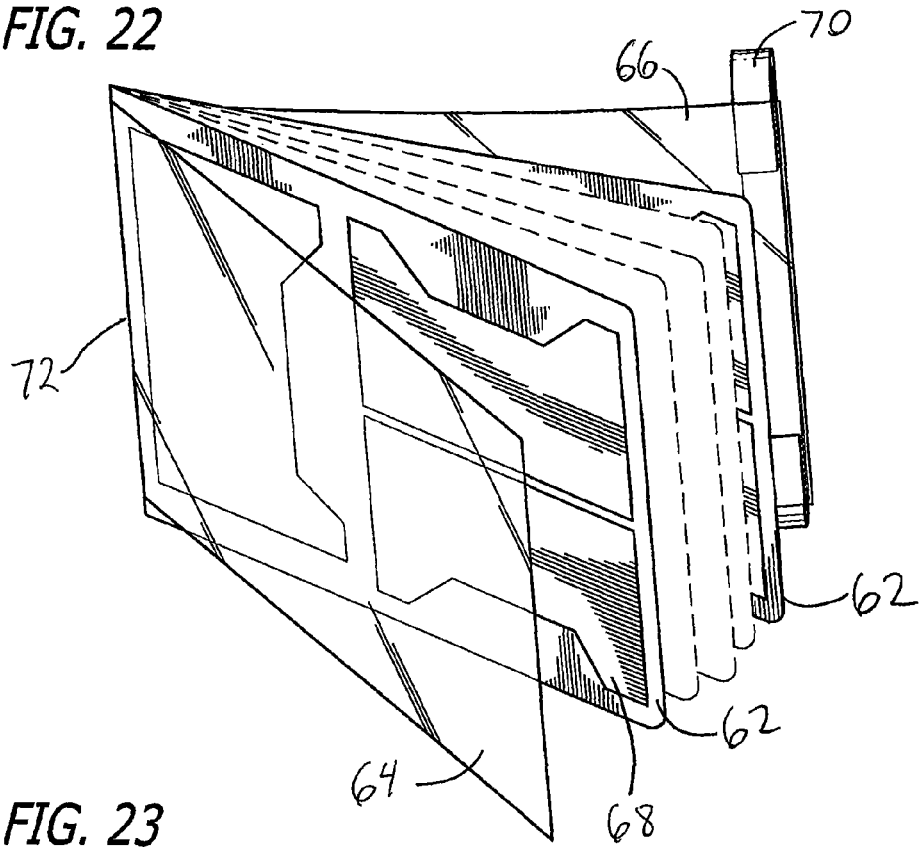
FIG. 22 is a front, side perspective view of the insert for the foldable organizer.
Figure 23:
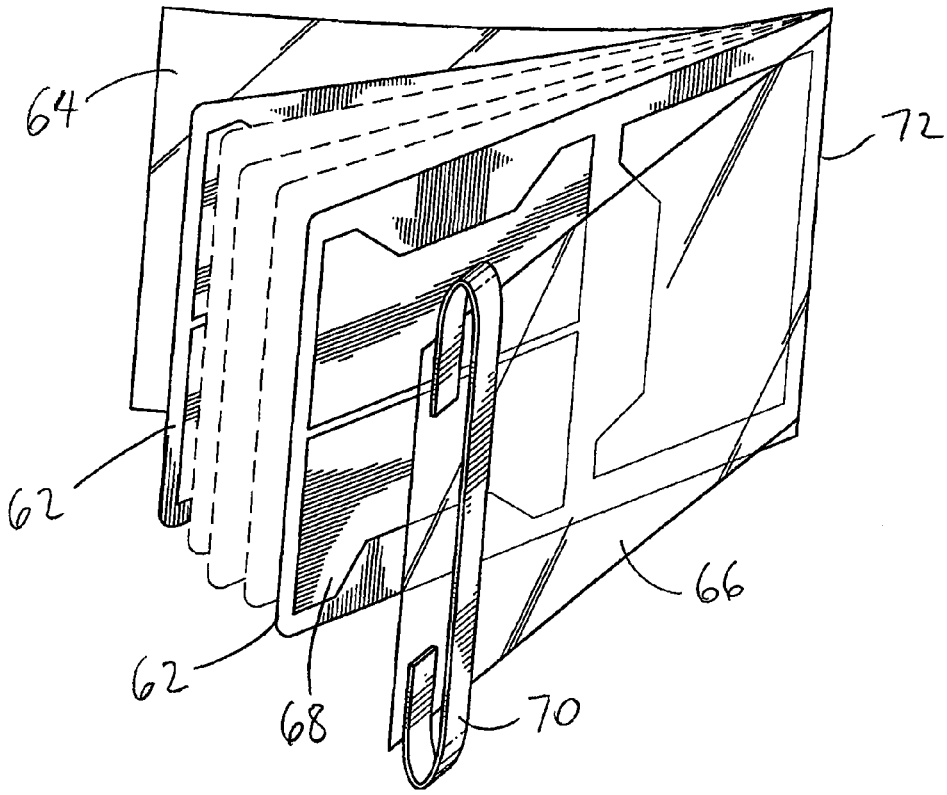
FIG. 23 is a rear, side perspective view of the insert for the foldable organizer.

The foldable organizer case 10 may be used with an insert 60 to store credit cards, driver's licenses, and similarly sized objects. The insert 60 preferably includes a plurality of sheets 62 with pockets 72 sized for holding credit cards. Preferably, each sheet includes three pockets on each side. The pocketed sheets 72 are sandwiched between a front sheet 64 and a back sheet 66 which are preferably clear to allow the user to identify the cards, as illustrated in FIGS. 8, 15, 22 and 23. In one embodiment, the back sheet is a formed from a semi-rigid piece of solid colored PVC material having a thickness of about 0.75 mm to 1.0 mm. Preferably, the back sheet is made from the same material as the interior of the case. All of the sheets are attached at one end 72, with the opposite end unattached to allow one to flip from one sheet to another in an accordion fashion, as illustrated in FIGS. 22 and 23. The sheets of the insert 60 are accessible near the top of the case in the open position, as illustrated in FIG. 8, as well as FIGS. 1, 11 and 12. The back sheet 66 includes an elastic fabric band 70 wraps around the front end of the case 10 to hold the insert 60 in place. Having the elastic fabric band 70 wrap around the top of the front end of the case 10 also allows access to the compartment 40, and allows the sheets of the insert 60 to be accessible near the top of the case 10 in an accordion fashion. The elastic band may include branding or a logo. The elastic band 70 may be attached to the back sheet 66 by riveting, thermoplastic bonding, another suitable means of attachment. In an alternative embodiment, the insert may be held in place on the top of the case by a clip.

In FIG. 18, an optional feature is illustrated on the front exterior side of the organizer 10. A front exterior pocket 14 is formed on the front exterior side 16 of the organizer case 10, which enables the user to insert and remove a logo, point of purchase advertisement, or other information chosen to be displayed to restaurant guests. Preferably, three sides of a clear plastic sheet are affixed to the front exterior section 16 of the foldable case 10, with a thumb tab cutout formed on the open side of the exterior pocket 14.

In one embodiment, the organizer may incorporate a credit card swipe machine for processing credit card transactions remotely from the organizer. The credit card swipe machine may incorporate a wireless communications means for relaying information to an from a central processing system or network.

Although embodiments of the invention are described, it is understood that those skilled in the art may conceive modifications and/or variations to the specific embodiments shown and described herein. Any such modifications or variations that fall within the purview of this description are intended to be included therein as well. Unless specifically noted, the words and phrases in the specification and claims are intended to be given the ordinary and accustomed meanings to those of ordinary skill in the applicable art(s). It is, therefore, evident that the particular embodiments disclosed above may be altered or modified and all such variations are considered within the scope and spirit of the invention.

What is claimed:

1. An apparatus comprising:

a folding case having a front exterior side, a rear exterior side, a top interior panel, and a bottom interior panel, the folding case configured to have an open position and a closed position;

an elongated opening running a substantial length of the folding case in the open position on a first side of the case, the elongated opening leading to an elongated compartment;

a leaf having a bottom end affixed within the compartment, the leaf further including a first pocket and a second pocket, each pocket having an opening and configured to hold a card, wherein the first pocket is located adjacent the top interior panel and the second pocket is located adjacent the bottom interior panel such that the first and second pockets do not interfere with closing the folding case wherein the first pocket and the second pocket are placed on the same side of the leaf, and the leaf further includes a third pocket and a fourth pocket placed on the side of the leaf opposite of where the first pocket and the second pocket are placed, and the third pocket is located adjacent the top interior panel and the second pocket is located adjacent the bottom interior panel such that all of the pockets do not interfere with closing the folding case when any of the pockets contain a card, and the lateral sides of the leaf are unaffixed to the compartment.

2. The apparatus of claim 1, further comprising an insert having an elastic strap to fasten the insert to the top interior panel at an end distal to the bottom interior panel when the folding case is in the open position and such that the elastic strap does not interfere with access to the elongated compartment, wherein the insert remains between the top interior panel and the bottom interior panel of the folding case when the folding case is in the closed position; the insert including a plurality of pages for holding cards.

3. The apparatus of claim 1, further comprising an insert fastened to one end of the folding case by a means for fastening, wherein the insert remains between the top interior panel and the bottom interior panel of the folding case when the folding case is in the closed position; the insert including a plurality of pages for holding cards, wherein each of the plurality of pages is joined at one end, and the means for fastening is located adjacent the end opposite the one end where the plurality of pages are joined.

4. The apparatus of claim 1, wherein the front exterior side of the folding case includes a clear sheet having a periphery, a substantial portion of the periphery being attached to the front exterior side to form a front exterior pocket.

5. An apparatus comprising:

a folding case having a front exterior side, a rear exterior side, a top interior panel, and a bottom interior panel, the folding case configured to have an open position and a closed position; wherein the rear exterior side of the folding case includes a backing, a flexible shell covering at least a substantial portion of the rear exterior side of the folding case, and a v-shaped opening integrally formed in the flexible shell, the v-shaped opening creating a rear pocket between the shell and the backing, the rear pocket configured to accept a card;

an elongated opening running a substantial length of the folding case in the open position on a first side of the case, the elongated opening leading to an elongated compartment;

a leaf having a bottom end affixed within the compartment, wherein the leaf includes a first pocket and a second pocket, each pocket having an opening and configured to hold a card, wherein the first pocket is located adjacent the top interior panel and the second pocket is located adjacent the bottom interior panel such that the first and second pockets do not interfere with closing the folding case.

6. The apparatus of claim 5, wherein lateral sides of the leaf are unaffixed, and the first pocket and the second pocket are placed on the same side of the leaf, and the leaf further including a third pocket and a fourth pocket placed on the side of the leaf opposite of where the first pocket and the second pocket are placed, and the third pocket is located adjacent the top interior panel and the second pocket is located adjacent the bottom interior panel such that all of the pockets do not interfere with closing the folding case when any of the pockets contain a card.

7. The apparatus of claim 5, further comprising an insert fastened to the top interior panel at an end distal to the bottom interior panel when the folding case is in the open position such that the elastic strap does not interfere with access to the elongated compartment, wherein the insert remains between the top interior panel and the bottom interior panel of the folding case when the folding case is in the closed position; the insert including a plurality of pages for holding cards.

8. The apparatus of claim 5, further comprising an insert fastened to one end of the folding case by a means for fastening, wherein the insert remains between the top interior panel and the bottom interior panel of the folding case when the folding case is in the closed position; the insert including a plurality of pages for holding cards, wherein each of the plurality of pages is joined at one end, and the means for fastening is located adjacent the end opposite the one end where the plurality of pages are joined.

9. The apparatus of claim 5, further comprising an insert between the top interior panel and the bottom interior panel of the folding case when the folding case is in the closed position; the insert including a plurality of pages for holding cards, wherein each of the plurality of pages is joined at one end.

10. The apparatus of claim 9, wherein the insert further includes an elastic strap for fastening the insert to the top interior panel at an end distal to the bottom interior panel when the folding case is in the open position such that the elastic strap does not interfere with access to the elongated compartment.

11. The apparatus of claim 5, wherein the front exterior side of the folding case includes a clear sheet having a periphery, a substantial portion of the periphery being attached to the front exterior side to form a front exterior pocket.

12. The apparatus of claim 5, wherein the rear pocket is configured to accept a credit card.

13. The apparatus of claim 1, wherein the first pocket is formed by attaching a first flexible material to the leaf, the second pocket is formed by attaching a second flexible material to the leaf.

14. The apparatus of claim 1, further comprising a rear pocket having a v-shaped opening formed on the rear exterior side of the folding case.

* * * * *